United States Patent [19]

Slaymaker

[11] 4,108,036

[45] Aug. 22, 1978

[54] METHOD OF AND APPARATUS FOR ELECTRONICALLY GENERATING MUSICAL TONES AND THE LIKE

[76] Inventor: Frank H. Slaymaker, 134 Glen Haven Rd., Rochester, N.Y. 14609

[21] Appl. No.: 600,687

[22] Filed: Jul. 31, 1975

[51] Int. Cl.[2] ..... G10H 1/00

[52] U.S. Cl. ..... 84/1.01; 84/1.17; 84/1.11; 84/1.19; 84/1.26; 364/410

[58] Field of Search ..... 84/1.01, 1.03, 1.17, 84/1.11, 1.19, 1.26; 235/152

[56] References Cited

U.S. PATENT DOCUMENTS

| | | | |
|---|---|---|---|
| 3,325,578 | 6/1967 | Park | 84/1.22 X |
| 3,515,792 | 6/1970 | Deutsch | 84/1.03 |
| 3,610,806 | 10/1971 | Deutsch | 84/1.26 |
| 3,688,010 | 8/1972 | Freeman | 84/1.24 X |
| 3,787,601 | 1/1974 | Campbell | 84/1.03 |
| 3,809,786 | 5/1974 | Deutsch | 84/1.01 |
| 3,809,788 | 5/1974 | Deutsch | 84/1.01 |
| 3,833,750 | 9/1974 | Iorio | 84/1.03 X |
| 3,861,263 | 1/1975 | Okudaira | 84/1.03 X |

OTHER PUBLICATIONS

T. K. Tawfig, "Designing Digital Filters", Digital Design, Oct. 1973.

*Primary Examiner*—Ulysses Weldon
*Attorney, Agent, or Firm*—Martin LuKacher

[57] ABSTRACT

Electronic musical tone generating methods and apparatus such as electronic organs and music synthesizers are described. An impulse response characteristic of the tones is represented by digital signals which are stored at different locations in a digital memory device. The memory is read out repetitiously at selected rates to produce tones of selected frequency or pitch (different notes of the musical scale). The interval during which the stored impulse response is read out is varied in order to generate the tones with different timbre such that different musical instruments (the stops in the electronic organ application) may be emulated.

20 Claims, 6 Drawing Figures

METHOD OF AND APPARATUS FOR ELECTRONICALLY GENERATING MUSICAL TONES AND THE LIKE

The present invention relates to methods of and apparatus for generating music electronically and particularly to methods and apparatus for generating tones through the application of digital electronic techniques.

The invention is especially suitable for use in electronic music synthesizers and electronic organs where musical tones and special effects are desired. The invention is however applicable to musical and other tone generating systems wherever tones having a different quality and pitch are desired.

The various approaches which have been suggested for the electronic generation of musical tones have been to synthesize the tones by the generation and/or alteration of analog waveforms or by storing the components of the wave forms, either in terms of digital representations of amplitude samples thereof or of the Fourier components thereof. U.S. Pat. No. 2,855,816 issued to Harry F. Olson and Herbert Belar on Oct. 14, 1958, may be referred to for a description of the means for synthesizing musical tones by the generation and alteration of the waveform of the tone. Reference may be had to U.S. Pat. Nos. 3,515,792; 3,816,637; and 3,639,913 for systems whereby digital representations of the wave form are stored and subsequently read out in order to synthesize different musical tones. The approach whereby Fourier components of the wave forms of the tones to be synthesized are utilized in the synthesis of musical tones, may be found in U.S. Pat. Nos. 3,809,786 and 3,809,788 through 3,809,790. There have also been suggested hybrid systems whereby analog wave forms representing different musical tones are switched and selected digitally through the use of digital switching systems and computing techniques. Such systems are described in U.S. Pat. Nos. 3,610,806; 3,696,201; and 3,697,661. All of these approaches and techniques suffer from various drawbacks.

The most flexible approach which has been suggested is the one involving the use of the Fourier components of the musical wave form. Inasmuch as the musical wave form can be and usually is highly complex containing components which are inharmonically related, even when complex computers and programming are used, many types of musical tones can not be realized through the use of the Fourier component technique. The remaining techniques are generally satisfactory in emulating the steady state portion of the musical tones. Musical tones however are characterized more by their transient characteristics rather than their steady state characteristics. It is extremely difficult to simulate these transient characteristics.

In addition, special effects such as vibrato are difficult to emulate using the foregoing approaches, since the amplitudes of the harmonic components of the vibrato tones are variable and therefore lack richness when synthesized using conventional techniques, such as waveform shaping and the digital readout of wave forms. The tones of certain instruments, for example flutes, which have noise and inharmonic components during their attack transients, are for similar reasons difficult or impossible to emulate with the conventional techniques of amplitude shaping frequency modulation and the readout of stored wave forms.

Further, musical notes in different portions of the scale have different spectral characteristics which are not a linear function of their frequency. Unless provisions are made for such changes in spectral characteristics, which provisions are incompatible with many conventional techniques or, at a minimum, may be implemented only with difficulty and complexity, in different frequency ranges some notes are dull while others sound shrill or strident.

It has been discovered, in accordance with the present invention, that tones can be generated which emulate various musical instruments as well as other tonal characteristics through the use of the impulse response characteristics which contains the information as to the spectral nature of the tones or other tonal sounds which are to be generated. The impulse response is conventionally associated with electronic filter networks as representing the amplitude-time function that appears at the output of the filter network when an impulse of unit amplitude is applied to the input of the network. Notwithstanding that this amplitude versus time function is not representative of tonal effects or musical tones themselves, it has been found, in accordance with the invention, that when the impulse response is convolved with repetitive input signals, desired tones and tonal effects can be produced, and these tones have the characteristics of the various instrumental timbres or other tonal characteristics which are desired. By varying the repetition rate of the input signal, the pitch or notes of the scale of these musical tones can be selected.

In effect, the impulse response is convolved with the input signals; the convolutions taking place at the input signal repetition rate. The spectral envelope or formant shape of the output wave is determined by the convolution. Thus, the impulse response characteristic of the desired instrumental timbres or other tonal characteristics may be used in accordance with the invention to generate analog signals having the requisite spectral characteristics in spite of the complexity, in terms of the contents of harmonic and inharmonic components of various amplitudes, in such wave shapes and even though transient characteristics (viz., attack or decay periods) of the wave shapes may be different from the steady state portions thereof. The impulse response characteristics of many musical tones is far more complex than the impulse response of electronic filters which can be synthesized using known network synthesis techniques. It has been found, in accordance with the invention, that the requisite impulse responses can be stored digitally, as in a digital memory. Digital representations, in the form of digital signals, say representing multi-bit digital words, are stored in the memory. The amplitude of the impulse response at successive intervals of time may be stored in the form of digital representations thereof in the memory. These representations (viz., the digital signals corresponding to the digital words stored in the memory for each representation) are read out of the memory in response to each of the repetitive input signals. The stream of digital representations thus read out of the memory, when translated into analog form, say with the use of a digital to analog converter, is the result of the convolution of the stored impulse response with the repetitive input signals and thus has the wave-shape characteristics of the selected tones, notwithstanding the complex nature thereof. The pitch of the tone is a function of the rate at which the impulse response is read out; that is the number of convolutions per unit time. Accordingly, by varying the repetition rate of the input wave, the number of readouts and the intervals of time during which the readouts occur concurrently (the extent of the overlap) are varied, thereby varying and selecting the pitch of the output tones. In this manner the various notes of the musical scale of a musical instrument may be selected.

It has also been found, in accordance with the invention, that the timbre of the tone which is generated can be varied by varying the interval during which the impulse response is read out. This in effect shifts the frequency components which characterize the spectral shape of the output wave. By decreasing the interval the frequency will be shifted upwardly; thus selected organ stops or instruments, which are characterized by certain relative proportions among the amplitudes of their various harmonics, may be selected by changing the interval during which the impulse response is convolved with the input wave. In the event that the impulse response is stored in a digital memory, this interval may be varied by reading out the digital representation of the stored impulse response at different rates; each read-out, of course, commencing upon occurrence of the repetitive input signal which controls the pitch of the tone.

Digital memories of various types may be used in practicing the invention. These memories may be of the conventional types using magnetic cores or may be integrated circuit solid-state memories, which are the type of memory presently preferred. The impulse response may be stored in the memory of a digital filter, say of the transversal type which is clocked at selected repetition rates corresponding to the pitch of the tone which is to be generated. Reference may be had to the IEEE Transactions on Audio and Electroacoustics, September, 1968, page 414; the Proceedings of the IEEE, April, 1975, page 634; and U.S. Pat. No. 3,303,335, issued Feb. 7, 1967, for further information regarding suitable digital filters.

Accordingly, it is an object of the present invention to provide improved methods of and means for electronic music synthesis and otherwise for the generation of musical tones and the like.

It is a further object of the present invention to provide improved methods of and means for the generation of musical tones with the aid of digital electronic techniques.

It is a still further object of the present invention to provide improved means for the generation of musical tones which may be used in electronic organs and the like.

It is a still further object of the present invention to provide improved methods of and apparatus for the generation of musical tones and the like in which the complexities and other deficiencies of electronic musical tone generation techniques which have heretofore been available are substantially eliminated.

The foregoing and other objects and advantages of the invention as well as additional features thereof will become more apparent from a reading of the following description when taken in connection with the accompanying drawings in which.

The relationships between the output waves having the desired spectral characteristics and formant which characterizes musical tones and the impulse response which is used in accordance with the invention in the generation of such tones may be clearly understood when such a wave is considered to have been generated by passing a source wave through a filter. The source wave may be any non-sinusoidal wave which may or may not be periodic having a complex amplitude-frequency spectrum, $F(w)$, where $w$ equals $2\pi f$, where $f$ is frequency. The filter may be considered to have a complex transfer characteristic $H(w)$. The frequency spectrum of the filter output wave is given by the expression:

$$W(w) = F(w)H(w). \quad (1)$$

Equation (1) relates the various frequencies that are present in the source wave and in the output wave. By using the convolution theorum for Fourier transforms, Equation (1) is re-written in time space rather than in frequency space. The amplitude-time characteristic is therefore:

$$w(t) = f(t)*h(t). \quad (2)$$

Figure 1:
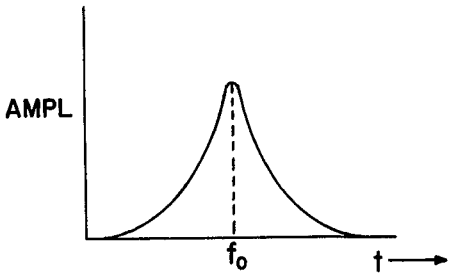
FIG. 1 is a curve showing the frequency response of a RLC bandpass filter.
Figure 2:
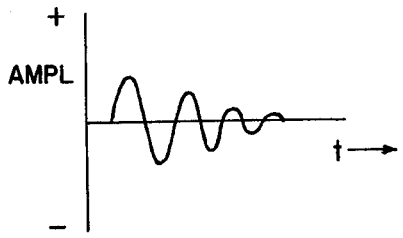
FIG. 2 is a curve showing the impulse response of the filter having the frequency response illustrated in FIG. 1.

In Equation (2) the star (*) represents a convolution operation. $w(t)$ is the Fourier transform of $W(w)$. $f(t)$ is the Fourier transform of $F(w)$, and $h(t)$ is the Fourier transform of $H(w)$. The term $h(t)$ is the impulse response of the filter. It represents the time function $w(t)$ which appears at the output of the filter when the filter is excited by a unit impulse. This impulse may be a short pulse. This pulse is the input wave or signal $f(t)$. Accordingly, if the impulse response characterizing the spectral nature or formant of the wave is convolved with the input signal in the same manner as a filter having the impulse response is excited repetitively by a repetitive pulse train, the output wave has the tonal characteristics established by the impulse response. In accordance with the invention this impulse response is stored in a memory which is read out by the repetitive input signal commencing upon occurrence of each repetition thereof. In this manner the stored impulse response is convolved with the input signal and the desired wave shape is generated. As an example, consider a RLC filter having the frequency response (viz., frequency spectrum characteristic) illustrated in FIG. 1, the impulse response of such a filter is illustrated in FIG. 2 and is a damped sine wave which is produced when the RLC circuit is excited by a single pulse. The frequency of the damped sine wave is the resonant frequency of the RLC circuit, $f_0$.

Figure 3:
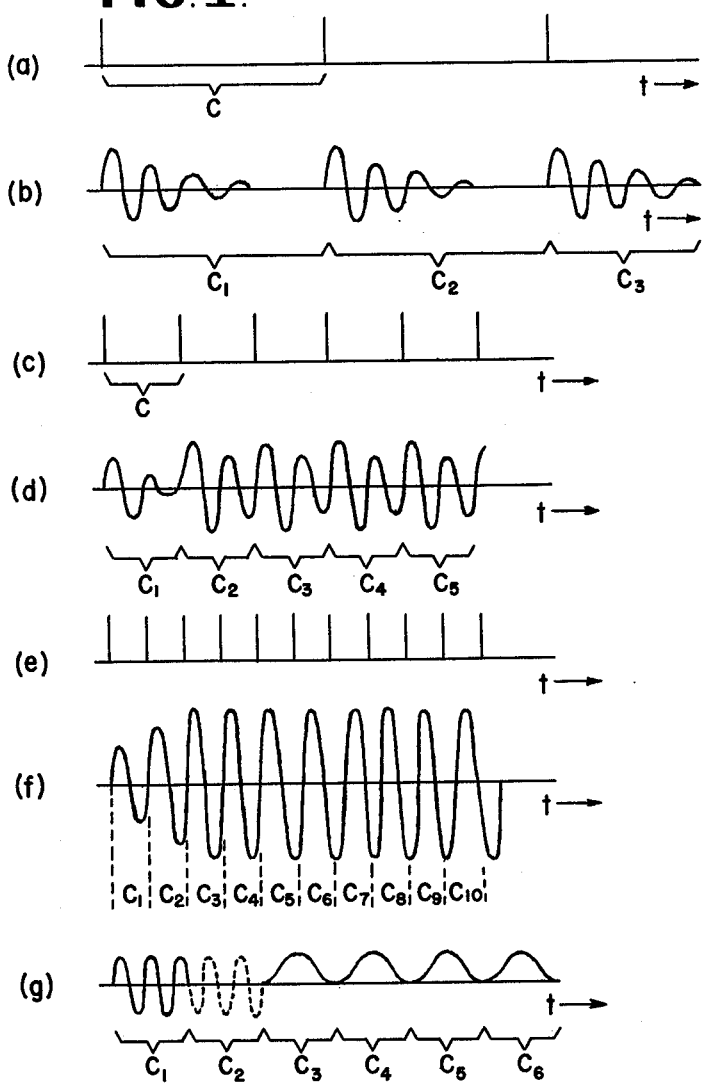
FIG. 3 is a series of waveforms which are explanatory of the generation of musical tones in accordance with the invention.

FIG. 3(*a*) is a repetitive train of pulses having the period of duration $c$. If the period $c$ between the pulses is longer than the length of the impulse response and the pulses repetitively excite the filter, the periodic wave shape appearing at the output of the filter is the very complex non-sinusoidal wave shown in waveform 3(*b*).

This wave repeats every period $c_1$, $c_2$, $c_3$ and so forth. Consider the case where the impulse signal is of higher frequency, such that the period $c$ becomes shorter than the duration of the impulse response. Such a repetitive input signal is shown in waveform (*c*) of FIG. 3. For each input the impulse response of FIG. 2 is repeated. In other words, while the filter is still ringing in response to the first pulse and producing a damped sine wave (its impulse response), another damped sine wave (another impulse response) commences in response to the second occurring pulse. Waveform (*d*) of FIG. 3 illustrates the resulting output. The successive responses are added algebraically (viz., where they occur concurrently and overlap) and are combined to form the wave shape shown in waveform (*d*) of FIG. 3. During the first few cycles (during the first period $c_1$) of the input signal waveform (*c*) the output wave is different from the wave shape that characterizes the sustained portion of the wave. Thus, the wave shape is characterized by a change in quality during the attack or build-up portion; and during the steady state or sustained portion has a periodicity corresponding to the periodicity of the input wave. It will be observed therefore that the pitch of the tone represented by the wave shape is dependent upon the frequency or repetition rate of the input signal.

The input wave is shown in waveform 3(*e*) as having a period of much shorter duration. The period of the wave is approximately equal to the period of the damped sine wave constituting the impulse response shown in FIG. 2. FIG. 3 waveform (*f*) illustrates the wave made up by algebraically adding the impulse responses which are produced and commenced upon occurrence of each of the pulses of the pulse train shown in FIG. 3, waveform (*e*). The amplitude of the output wave of waveform (*f*) gradually builds up during the attack portion thereof. The steady state portion is essentially sinusoidal and has a frequency equal to the frequency of the input wave. Accordingly, the impulse responses are stored and then read out of storage by the input signal. Impulse response is effectively convolved with the result that an output wave is produced having tonal characteristics characterized by the impulse response and a pitch characterized by the repetition rate of the input signals.

The impulse response may be characteristic of any desired musical instrument tonal effect or the like. It may have inharmonic components which are present only during certain transient intervals. Consider the characteristic of a flute pipe in an organ. There a higher partial, which may be inharmonic, builds up first, and the harmonic partials build up later. The stored impulse response includes an inharmonic sinusoidal component of such frequency and duration that at the onset of the tone the inharmonic partial builds up quickly and then gradually drops in value until it is essentially zero amplitude, the timbre of flute pipes can be reproduced and the music from such pipes emulated.

A simplified example of this case is shown in waveform (*g*) of FIG. 3, where the impulse response has a duration of three intervals, $c_1$, $c_2$ and $c_3$; $c_2$, $c_3$, and $c_4$; $c_3$, $c_4$ and $c_5$; $c_4$, $c_5$ and $c_6$; and so forth. The impulse response consists of a sinusoidal portion made up of five cycles of a frequency 2½ times the frequency of the input signal which is followed by a rounded pulse. Since convolution is a linear process, the sum of the impulse response in the second interval $c_2$ is made up of sine waves of opposite phase which of course cancel. The sine waves which overlap in the other intervals $c_3$, $c_4$, $c_5$, $c_6$ and so forth are also of opposite phase and cancel. The output wave form thus begins with a sine wave and then changes to a periodic tone made up of the rounded pulses. This illustrates how impulse responses which have inharmonic components are used such that both an inharmonic partial and, if necessary, noise or other effects can exist during the attack portion of the tone and only harmonic during the steady state portion thereof. Therefore, flute pipe timbres can, it will be observed, readily be generated through the use of the invention.

The wave forms of FIG. 3 also illustrate how the tone quality or timbre of the generated tones may be varied by varying the length of interval during which the impulse response is reproduced and read out of storage. The timbre is a function of the poles and zeros of the spectral response. For example, in the case of the RLC filter response illustrated in FIG. 1 there is a single resonance at $f_0$. Changing the frequency position of the poles and zeros may be accomplished by changing the interval during which the impulse response is read out. In the simple case illustrated in FIG. 3, wave forms (*a*) through (*f*), which is for a musical instrument of the woodwind type, if the resonant frequency $f_0$ was approximately 450 $H_z$, the generated tone resembles and has the timbre of a bassoon. If $f_0$ is approximately 2000 $H_z$ the timbre resembles that of an oboe. Accordingly, by varying the interval commencing after each pulse of the repetitive pulse train, shown for example in waveforms (*a*) (*c*) and (*e*) of FIG. 3, during which the impulse response was produced and read out of memory, a different timbre would result, since the resonant frequencies of the spectral response of the generated tone vary depending upon the length of time selected for the read-out of the impulse response. Inasmuch as these timbres correspond to the stops in an organ they will be referred to hereinafter as stops.

Figure 4:
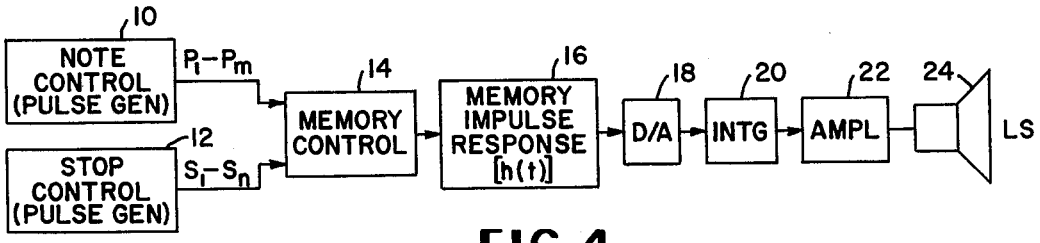
FIG. 4 is a block diagram illustrating in generalized form apparatus which may be used in practicing the invention.

FIG. 4 illustrates in general apparatus of the type which may be used in an electronic organ for generating tones. Similar apparatus may be used in music synthesizers whether under keyboard or coded record control. Two pulse generators 10 and 12 provide pulse trains having selected repetition rates. The pulse generator 10 thus can provide pulse trains having repetition rates $P_1$ through $P_m$, each at a different successively higher repetition rate. By selecting a pulse train $P_1$ through $P_m$ different pitches or notes of the scale of musical tones are selected. Accordingly, the pulse generator 10 is referred to as the note control.

The other pulse generator 12 selectively provides pulse trains $S_1$ through $S_n$. The pulse trains $S_1$ to $S_n$ are utilized to time the read-out of the impulse response and the repetition rate of these pulse trains is inversely proportional to the length or interval of time during which the impulse response is read out. Since this length of time determines the timbre of the musical tones, the pulse generator 12 is referred to as the stop control. Both note control pulse trains P and the stop control pulse trains S are applied to a memory control unit 14 which controls the readout of a memory in which the impulse response $h(t)$ is stored, such that the readout of the impulse response is initiated by each P pulse and executed by the S pulses from the stop control 12. The memory 16 is suitably a digital memory having addresses or storage locations for digital representation, say in the form of binary coded words containing a multiplicity of bits, of the impulse response at successive increments of time which are equally spaced in time from each other. The memory may for example be a solid-state memory available in integrated circuit form having 1,024 words each eight-bits long stored therein. The digital number in each storage location represents the amplitude of the impulse response at a successive one of 1,024 equally spaced increments of time for the duration of the impulse response. In other words, successive samples of the impulse response are represented by different ones of the digital words stored in the memory. The memory may alternatively be a magnetic drum or disc, punched cards, or magnetic core. In the latter cases additional buffer storage which may be designed in accordance with conventional digital logic design techniques, is used in order to control the readout of the stored impulse responses, the note control and stop control pulses P and S. Alternatively, the memory may be in the form of a digital filter in which the weights are digital numbers representing the samples of the impulse response. In other words the digital filter will have an impulse response characterizing the desired musical tone. The rate at which the signals are circulated through the register of the filter is controlled by the stop control pulses S, while the commencement of each recirculation is controlled by the note control pulses P. For further information respecting the location of the shift registers and weight control registers of a digital filter suitable for use as the memory 16, reference may be had to the above-mentioned U.S. Pat. No. 3,303,335.

The readout of the memory may, as discussed above, be constituted of digital words for the impulse response, which when read out are overlapping (viz., the successive readouts of the impulse response are at least partially concurrent). The digital words of such overlapping impulse responses are combined by being algebraically summed. Such summation may be obtained by means of digital adding logic. Even the highest frequency of the tone to be generated will not exceed 30,000 $H_z$ because such tones are beyond the limits of audibility. The digital words are read out by the stop control pulses which, for the example, where these pulses are at a 30,000 $H_z$ rate, occur every $33\frac{1}{3}$ microseconds. By providing a slight delay between readouts of successive impulse response, for example, a delay of one-quarter the interval between the stop control pulses, or $8\frac{1}{3}$ microseconds, the digital word of successive impulse responses will be closely adjacent each other. In such event, digital adders may be dispensed with by virtue of inherent integration characteristics of the sound reproducing system which effectively adds such closely adjacent components. More specifically, the digital words read out of the memory 16 are translated into pulses of amplitude corresponding to the value of these words by a digital to analog converter 18. The analog pulses are integrated as in a separate integrator 20, which may be provided by a low-pass filter. The output of the integrator is amplified in an amplifier 22 which drives the sound reproducer such as a loudspeaker 24. In the event that the integration and filtering characteristics of the sound reproducing system constituted by the amplifier 22 and loudspeaker 24 has sufficient low-pass filtering and integration characteristics, the integrator 20 may be dispensed with.

Figure 6:
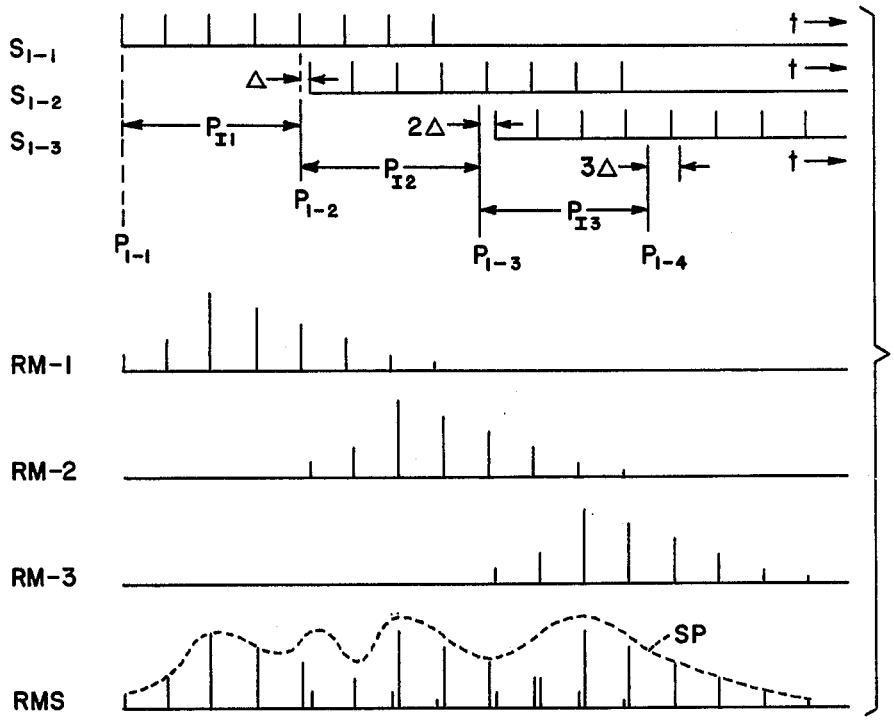
FIG. 6 is a timing chart illustrating the timing of various pulses which are generated in the system shown in FIG. 5.
Figure 5:
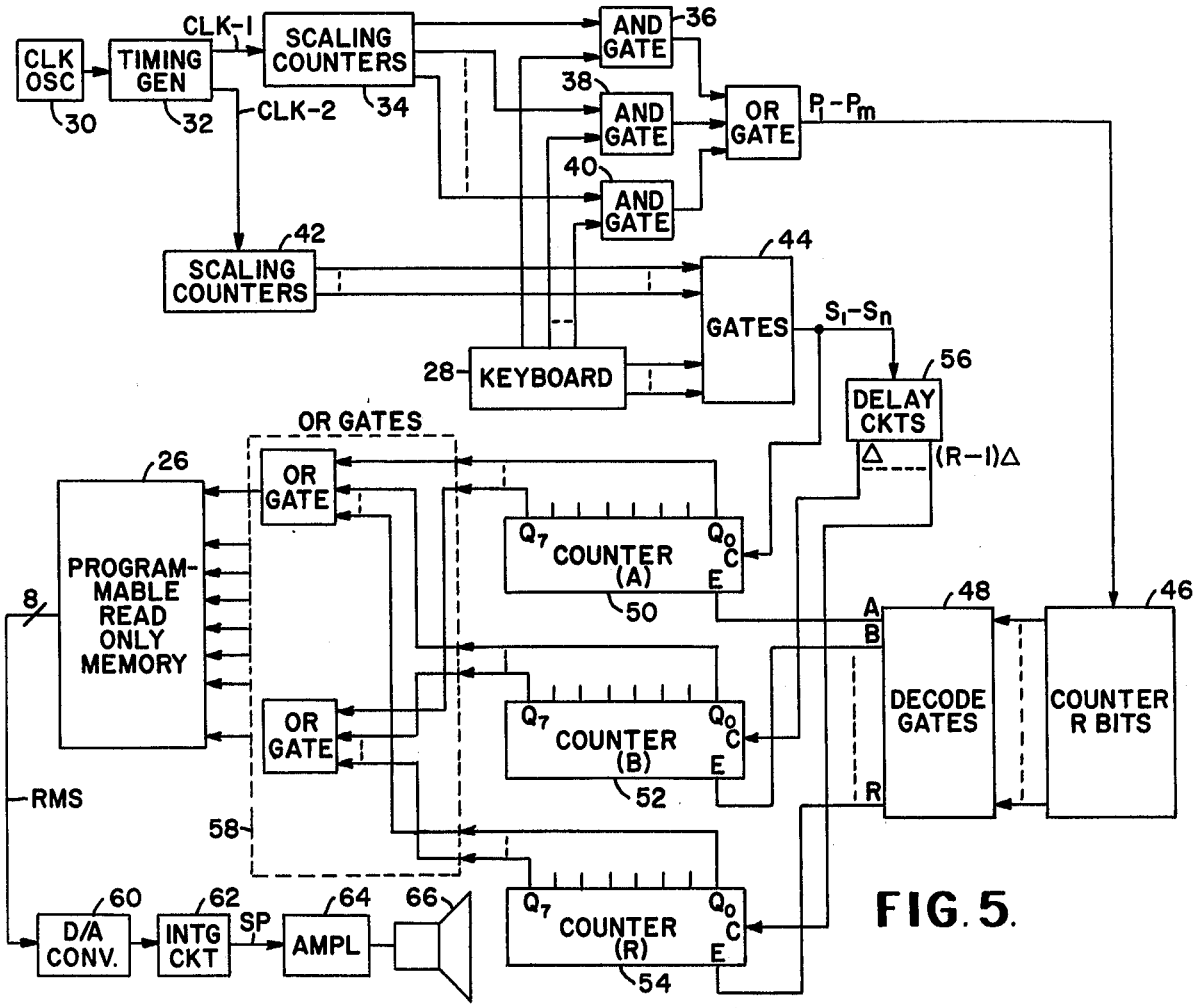
FIG. 5 is a block diagram illustrating apparatus by means of which the invention may be implemented in accordance with an embodiment thereof.

Referring now to FIGS. 5 and 6, there is shown an electronic organ in accordance with an embodiment of the invention. The impulse response is stored in the form of separate digital representations or digital words, each eight bits long, in a programmable read-only memory 26. A solid-state integrated circuit memory such as the type 1702A which can store 256 of such eight-bit words, is suitable. These words are stored by programming the memory, for example in the course of fabrication of the organ, such that each of these words represents a different sample of the impulse response. The note control and pulse control are operated by a keyboard 28 which may be similar to a conventional organ keyboard having keys for playing different notes and switches for selecting different stops. A clock oscillator 30 which may be a high frequency clock, drives a timing generator 32 which produces two trains of clock pulses of the same frequency, but displaced in phase so as to prevent overlapping of the logic operation. The first of these clocks CLK-1 is used to generate the note control pulse trains $P_1$ through $P_m$. The second clock CLK-2 is used to generate the stop control pulses $S_1$ through $S_n$. CLK-1 is applied to scaling counters 34 which divide CLK-1 in frequency, using rate multiplication techniques if necessary, to produce the pulse train of frequency $P_1$ through $P_m$. Other frequency synthesis techniques may also be used, if desired. Only three lines are shown coming from the counters 34 to simplify the illustration. Each train is gated through a separate AND gate 36, 38 and 40, which gates are selectively enabled by the note control keys of the keyboard 28. A selected one of the pulse trains $P_1$ through $P_m$ is then outputted to the memory control.

The CLK-2 pulses are applied to scaling counters 42 having lower dividing ratios than the counters 34, since the stop control pulses are at a higher repetition rate than the note control pulses. The selected stop control pulse train $S_1$ through $S_n$ is obtained by gates 44 which are operated by the keyboard stop control switches. The gates 44 may be a set of AND gates similar to the gates 36 through 40.

The memory control consists of a R-bit counter 46 which through associated decode gates 48 control R up-counters 50, 52 and 54. Only the first, second and last of the set of counters, including the counters 50, 52 and 54, are shown to simplify the illustration. These counters count the S pulses which are applied to the second and subsequent counters 52 and 54 by way of delay circuit 56. The words counted in the counters are used to address and read out the memory 26 and are applied to the memory by way of OR gates 58 which are R in number.

In operation the note control pulses P are counted in the R-bit counter 46. R is the highest number of overlapping impulse responses which may be used in the generation of the selected musical tones. The decode gates provide enabling signals A, B through R, to the enable inputs of the counters 50, 52 and 54. The enable inputs are either self-latching, or flip-flop latches (not shown) may be employed, such that once enabled the counter which is enabled will continue to count through its cycle or count capacity after which it will be inhibited until the next enabling pulse appears. The stop pulses are applied to the first counter for counting therein without any delay. The second counter has its clock pulses delayed by a short period of time $\Delta$ which is slightly less than 1/Rth of the period of the highest frequency S pulse $S_n$. The third counter (not shown) will have its S pulses delayed by 2 $\Delta$. The fourth counter (not shown) by 3 $\Delta$, and the Rth counter 54 by (R-1) $\Delta$. As each counter proceeds to count through its cycle, it will for each S pulse provide a different digital word or address through the OR gate 58 to the memory 26 and the digital word at that address will be read out.

The counters 50 to 54 are illustrated as being eight-bit counters. Accordingly, 256 S pulses are required to cycle the counters back to zero, and 256 different addresses corresponding to the 256 digital words stored in the memory 26 will be read out in response to 256 addresses from each counter.

The digital words are translated into pulses of different amplitude by a digital to analog converter 60 which drives a reproducing system as may include an integrating circuit 62, an amplifier 64 and a loudspeaker 66.

The operation of the system will be further apparent from FIG. 6 where the number of S pulses which are required to cycle the counters 50, 52, 54 are shown as being 8 pulses in order to simplify the illustration. The first note control pulse $P_1$ causes the first counter to produce the train of pulses $S_{1-1}$. The next P pulse $P_2$ occurs after an interval $P_{I1}$. Inasmuch as the $S_1$ pulses are delayed by an amount Δ by the delay circuit 56, the next set of S pulses $S_{1-2}$ commences after the second $P_1$ pulse, $P_{1-2}$, subsequent to the delay Δ. Similarly, the third set of S pulses is applied to the third counter, after the occurrence of the $P_{1-3}$ pulse and a 2 Δ delay. The $P_{1-4}$ pulse will enable the third counter to be cycled by eight additional S pulses $S_{1-3}$ after a three Δ delay. It will be observed that the first and second set of S pulses overlap during an interval $P_{I2}$, while the second and third set of S pulses $S_{1-2}$ and $S_{1-3}$ overlap during the interval shown in $P_{I3}$. The eight S pulses $S_{1-1}$ which cycle the first counter 50 present eight different addresses to the memory 26 and result in eight consecutive readouts shown as RM-1 in FIG. 6. Similarly, the second set of pulses $S_{1-2}$ results in a second set of readouts from the memory 26, each concurrent with a separate one of the $S_{1-2}$ pulses. The third set of pulses $S_{1-3}$ similarly produces a third set of readouts RM-3 from the memory 26. These readouts are shown as pulses of different amplitude which correspond to the values of the digital words which are read out of the memory. The combined readout is shown as RMS. Where successive impulse responses overlap, readout of successive impulse responses also overlap. These readouts are shown as adjacent pulses in the RMS curve which pulses are separated by the delay time Δ. The pulses RMS are illustrative of the pulses produced by the digital to analog converter 60. The dash lines illustrate the output SP of the integrating circuit 62. The SP wave is of course shaped so as to have the desired formant of the sounds which are reproduced by the speaker 66. It will be observed therefore that the overlapping impulse responses are additively combined so as to provide the selected wave shapes. Therefore by operating the keyboard the notes at different stops will be provided and electronic organ music will be produced.

From the foregoing description it will be apparent that there has been provided improved methods of and apparatus for the synthesis of music and the generation of musical tones, tonal effects and the like. While embodiments of the invention which are adapted to synthesize music and to provide a digital electronic organ have been described herein, it will be appreciated that variations and modifications thereof as well as the hereindescribed methods will, undoubtedly suggest themselves to those skilled in the art. Accordingly, the foregoing description should be taken merely as illustrative and not in any limiting sense.

What is claimed is:

1. The method of generating tones having selected characteristics, which method comprises the steps of (a) storing information in the form of successive samples which constitute the impulse response of a circuit, which response contains spectral components of the tones to be generated, and (b) repetitively reading out said stored information during intervals of time which commence at selected rates thereby providing the convolution of said impulse response with a series of unit impulses in which the repetition rates of said unit impulses are said selected rates for generating selected notes of said tones.

2. The invention as set forth in claim 1 including the further step of selectively varying the duration of said intervals of time during which said information is read out thereby generating said selected notes with characteristics of different musical instruments and the like.

3. the invention as set forth in claim 2 wherein said storing step is carried out by storing in the form of said successive samples the impulse response characteristics of a plurality of tones to be generated.

4. The invention as set forth in claim 2 wherein said information is in the form of digital representations of said successive samples, and said storing step is carried out with the aid of a digital memory.

5. The invention as set forth in claim 2 wherein said samples are in the form of digital representations of the amplitude of said impulse response at successively spaced increments of time, and said storing step is carried out with the aid of a memory having storage for said digital representations.

6. The invention as set forth in claim 5 wherein said step of reading out said information is carried out by reading out of said memory all of the digital representations which constitute said impulse response during each of said intervals of time.

7. The invention as set forth in claim 6 wherein said repetitive reading out step includes the step of timing the commencement of successive ones of said intervals such that said successive intervals are partially concurrent and the digital representations of successive impulse responses are read out while said intervals are partially concurrent.

8. The invention as set forth in claim 7 including the further step of combining the values of said digital representations, said successive impulse responses which are read out while said intervals are concurrent.

9. The invention as set forth in claim 8 including the further step of translating said digital representations and said combined digital representations into an analog signal.

10. The invention as set forth in claim 9 including the further step of reproducing said signal in the form of an audible acoustic signal.

11. The invention as set forth in claim 5 wherein said step of selectively varying the duration of said intervals is carried out by reading out said digital representations at selectively different rates thereby selectively varying the duration of said successively spaced increments of time.

12. Apparatus for generating musical and the like tones which comprises means for storing successive samples which define the impulse response which characterize the special characteristics of said tones, means for providing repetitive signals having selected repetition rates, and means responsive to said repetitive signals and operative upon said samples in said storing means for convolving said impulse response therewith for generating said tones with different pitches corresponding to the repetition rate of said repetitive signals.

13. The invention as set forth in claim 12 further comprising means for varying the interval during which said signals and said impulse response are convolved thereby varying the timbre of the generated tones.

14. The invention as set forth in claim 13 wherein said storing means is a digital memory, and said impulse response is a plurality of digital signals stored in said memory, said digital signals corresponding to said samples, said convolving means comprising memory control means operated by said repetitive signals for reading out all said digital signals upon each repetition of a first of said repetitive signals, and said interval varying means includes means for generating a second of said repetitive signals having selected repetition rates, and means included in said control means for reading out of said memory successive ones of said digital signals upon occurrence of successive ones of said second repetitive signals.

15. The invention as set forth in claim 14 wherein said means for providing said second repetitive signals includes means for generating said signals at repetition rates which are higher than the repetition rate of said first named repetitive signal whereby sets of stored digital signals representing said impulse response can be read out successively from said storing means.

16. The invention as set forth in claim 15 wherein said control means includes means operated by each of said first repetitive signals for providing a plurality of said second repetitive signals at least equal in number to the digital signals in each said set thereof which represents said impulse response whereby successive readouts of said stored impulse response can occur in intervals of time which are partially concurrent and overlapping.

17. The invention as set forth in claim 16 further comprising means for additively combining the digital signals of the successive impulse responses which are in overlapping relationship.

18. The invention as set forth in claim 17 wherein said combining means includes a digital to analog converter for converting said digital signals into pulses of amplitude corresponding to the value thereof, and means for translating said pulses into an analog signal.

19. The invention as set forth in claim 16 wherein said control means comprises multiplexing means responsive to said first repetitive signals for providing said plurality of second repetitive signals upon occurrence of each said first repetitive signals.

20. The invention as set forth in claim 19 wherein said storing means is a digital memory for storing each of said digital signals at a different address corresponding to a different multi-bit digital number, and said multiplexing means comprises a first counter and a plurality of second counters, said second counters each having separate outputs each for a different bit of said multi-bit number, means for connecting said outputs of said second counters to said memory for applying said multi-bit numbers thereto, means for applying said second repetitive signals to each of said second counters to be counted therein, means for applying said first repetitive signals to said first counter to be counted therein, and means operated by said first counter for successively enabling different ones of said second counters to count said second signals when said first counter has a different count therein.

* * * * *